US009719260B2

(12) United States Patent
Gassman

(10) Patent No.: US 9,719,260 B2
(45) Date of Patent: Aug. 1, 2017

(54) ROOF BAFFLE

(71) Applicant: Owens Corning Intellectual Capital, LLC, Toldeo, OH (US)

(72) Inventor: Paul E. Gassman, Newark, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 0 days.

(21) Appl. No.: 14/600,067

(22) Filed: Jan. 20, 2015

(65) Prior Publication Data

US 2016/0208494 A1 Jul. 21, 2016

(51) Int. Cl.

| | |
|---|---|
| ***F24F 7/02*** | (2006.01) |
| ***E04D 1/30*** | (2006.01) |
| ***E04D 13/17*** | (2006.01) |
| *E04D 1/36* | (2006.01) |
| *F24F 7/00* | (2006.01) |

(52) U.S. Cl.

CPC ..... *E04D 13/178* (2013.01); *E04D 13/176* (2013.01); *E04D 1/30* (2013.01); *E04D 1/36* (2013.01); *F24F 7/00* (2013.01); *F24F 7/02* (2013.01)

(58) Field of Classification Search

CPC ..... E04D 13/176; E04D 1/30; E04D 1/36; E04D 13/174; E04D 13/178; E04B 1/7069; F24F 7/02; F24F 7/00

USPC ..... 52/198, 95; 454/364, 365, 366

See application file for complete search history.

(56) References Cited

U.S. PATENT DOCUMENTS 2,304,042 A * 12/1942 Upton ..... F28D 1/024 392/364
4,096,790 A * 6/1978 Curran ..... F24F 7/02 454/260
4,184,416 A * 1/1980 Koontz ..... E04D 13/178 454/260
4,611,443 A * 9/1986 Jorgensen ..... E04D 13/178 454/260
4,660,463 A * 4/1987 Bottomore ..... E04D 13/178 454/260
4,776,262 A * 10/1988 Curran ..... E04D 13/178 454/260
5,052,286 A * 10/1991 Tubbesing ..... F24F 7/02 454/365
6,128,869 A * 10/2000 Brotherton ..... F24F 7/02 52/198
6,202,372 B1 3/2001 Powell
6,482,084 B2 * 11/2002 Hansen ..... F24F 7/02 454/365
7,094,145 B2 * 8/2006 Rye ..... B26F 1/20 454/365
7,662,037 B2 * 2/2010 Polston ..... E04D 13/174 454/365
7,856,764 B2 * 12/2010 Kortuem ..... E04D 13/17 454/260

(Continued)

FOREIGN PATENT DOCUMENTS

GB 2281389 3/1995

*Primary Examiner* — Phi A

(74) *Attorney, Agent, or Firm* — Calfee, Halter & Griswold LLP

(57) ABSTRACT

A baffle, for use with a roof deck, includes a main body portion and an attachment surface. The baffle is installable from the exterior side of a roof deck through an opening in the deck to form an air flow path between the interior side of the roof deck and the main body portion. The attachment surface may be attachable to the roof deck while the main body extends along the interior side of the roof deck.

16 Claims, 4 Drawing Sheets

(56) References Cited

U.S. PATENT DOCUMENTS

| | | | | |
|---|---|---|---|---|
| 7,861,467 | B2 | 1/2011 | Rosten et al. | |
| 8,137,170 | B2 * | 3/2012 | Klement | E04D 13/178 126/621 |
| 8,322,089 | B2 * | 12/2012 | Railkar | E04D 13/174 454/364 |
| 8,790,167 | B2 * | 7/2014 | Holland | E04D 13/174 454/242 |
| 2002/0038531 | A1 * | 4/2002 | Freshwater | E04D 1/30 52/518 |
| 2003/0029098 | A1 * | 2/2003 | Reeves | E04D 1/36 52/57 |
| 2004/0237428 | A1 * | 12/2004 | Headrick | E04D 13/176 52/198 |
| 2007/0072540 | A1 * | 3/2007 | Ciepliski | F24F 7/02 454/365 |
| 2007/0283639 | A1 * | 12/2007 | Kortuem | E04D 13/178 52/198 |
| 2008/0064320 | A1 * | 3/2008 | Polston | E04D 13/174 454/365 |
| 2008/0209822 | A1 | 9/2008 | Rosten | |
| 2009/0049769 | A1 * | 2/2009 | Kaseda | E04D 13/174 52/198 |
| 2011/0308178 | A1 * | 12/2011 | Daddio | E04D 13/174 52/198 |
| 2013/0023197 | A1 * | 1/2013 | Grisham | F24F 7/02 454/260 |
| 2013/0042543 | A1 * | 2/2013 | Letts | E04D 13/152 52/95 |
| 2014/0099877 | A1 * | 4/2014 | Gassman | E04D 13/178 454/366 |
| 2014/0308891 | A1 * | 10/2014 | Holland | E04D 13/174 454/365 |

* cited by examiner

ROOF BAFFLE

FIELD OF THE INVENTION

The present application generally relates to roof baffles, such as baffles that fit between roof rafters, trusses or other roof deck support members, and, more particularly, to roof baffles that can be installed externally through an opening in a roof deck.

BACKGROUND OF THE INVENTION

Buildings, such as for example residential buildings, are often covered by a sloping roof deck. The interior portion of the building located directly below the sloping roof deck forms a space called an attic. It is known to ventilate attics, thereby helping to prevent the formation of condensation or buildup of excess heat. Some buildings are formed with structures and mechanisms that facilitate attic ventilation. For example, structures configured to passively facilitate attic ventilation include ridge vents and undereave or soffit vents. Ridge vents are structures positioned at the roof ridge and the undereave or soffit vents are positioned near the gutters. Attic ventilation occurs from fresh air that flows into the attic via the undereave or soffit vents, flows upward through the attic, and exits out of the ridge vent.

Some buildings, however, may not be formed with structures and mechanisms that facilitate attic ventilation. For example, some homes do not have soffits in which to install vents, thus other intake venting solutions are needed. One approach for providing an intake vent on soffit-less, or in some cases, an intake vent to cooperate with a soffit vent on homes with soffits, is to provide an intake vent installed in the roof deck. An example of a roof deck intake vent is disclosed in U.S. Published Patent Application 2014/0099877 to Gassman et. al., the entire disclosure of which is incorporated herein by reference. The roof deck intake vent in U.S. 2014/0099877 utilizes an opening cut into the roof deck through which the roof deck intake vent directs air flow. It is known to install baffles along the interior side of the roof deck to create a space between each rafter for air to flow freely up the rafters and into the attic.

SUMMARY OF THE INVENTION

A baffle for use with a roof deck is disclosed. The baffle includes a main body portion and an attachment surface. The baffle is installable from the exterior side of a roof deck through an opening in the deck to form an air flow path between the interior side of the roof deck and the main body portion The attachment surface may be attachable to the roof deck while the main body extends along the interior side of the roof deck.

Various objects and advantages will become apparent to those skilled in the art from the following detailed description of the invention, when read in light of the accompanying drawings. It is to be expressly understood, however, that the drawings are for illustrative purposes and are not to be construed as defining the limits of the invention.

DETAILED DESCRIPTION OF THE INVENTION

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

As described herein, when one or more components are described as being connected, joined, affixed, coupled, attached, or otherwise interconnected, such interconnection may be direct as between the components or may be indirect such as through the use of one or more intermediary components. Also as described herein, reference to a "member," "component," or "portion" shall not be limited to a single structural member, component, or element but can include an assembly of components, members or elements.

In accordance with embodiments of the present invention, a roof baffle is provided. It will be understood the term "ridge" refers to the intersection of the uppermost sloping roof planes. The term "roof deck" is defined to mean the plane defined by a roof surface. The term "sheathing", as used herein, is defined to mean exterior grade boards used as a roof deck material.

Figure 1:
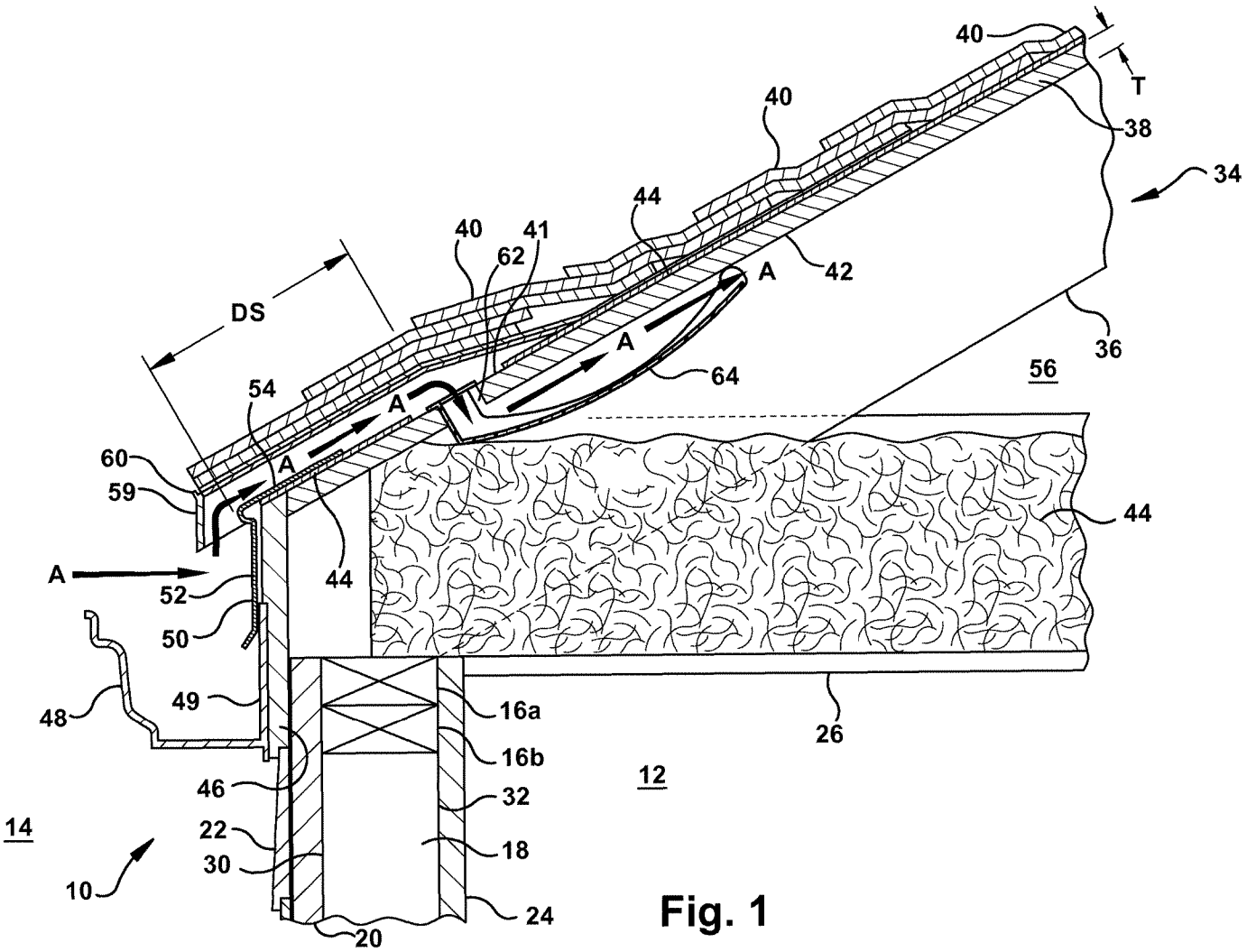
FIG. 1 is a side view, in elevation, of a portion of a building structure incorporating an exemplary embodiment of a baffle.
Figure 2:
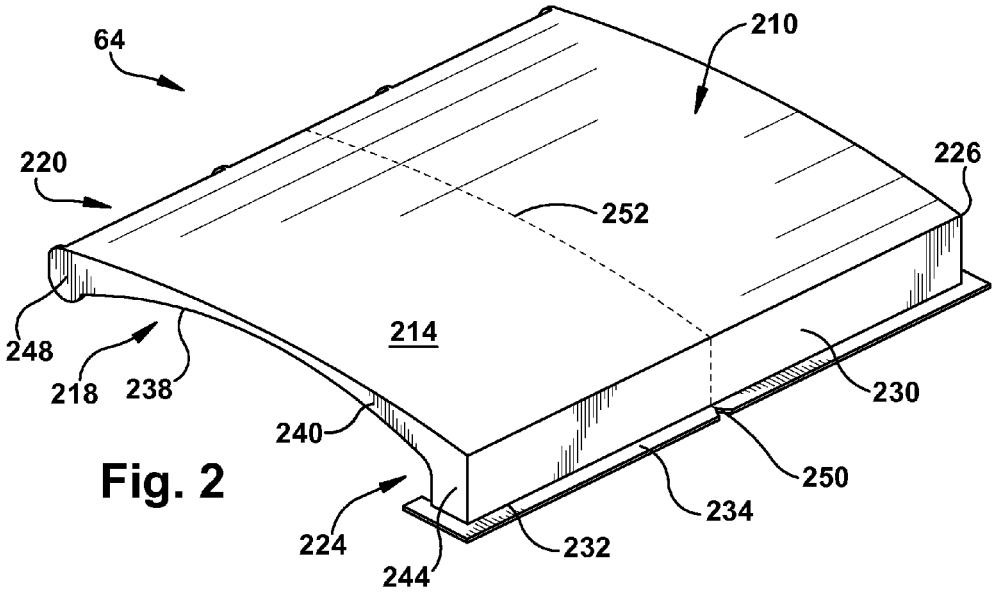
FIG. 2 is a perspective view of the bottom of the baffle of FIG. 1.
Figure 3:
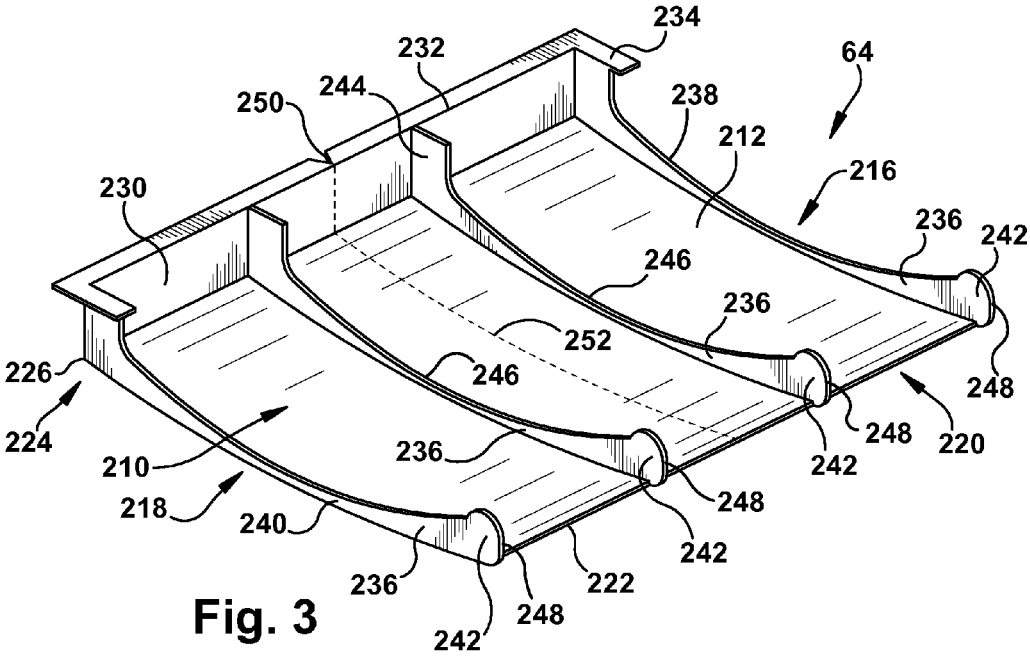
FIG. 3 is a perspective view of the top of the baffle of FIG. 1.
Figure 4:
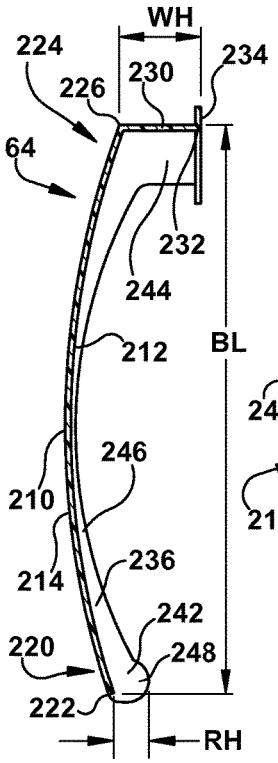
FIG. 4 is a side view of the baffle of FIG. 1.
Figure 5:
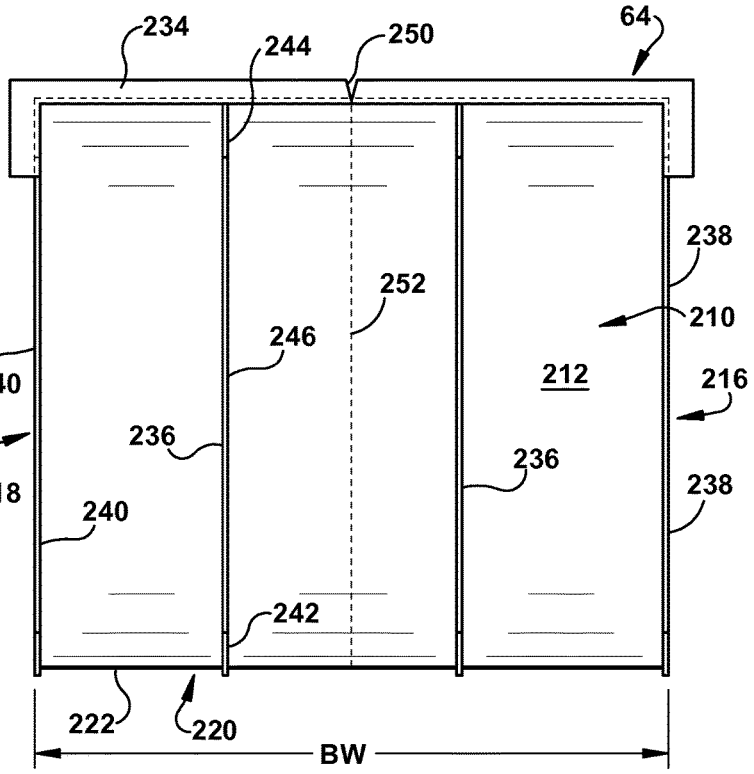
FIG. 5 is a top view of the baffle of FIG. 1.
Figure 6:
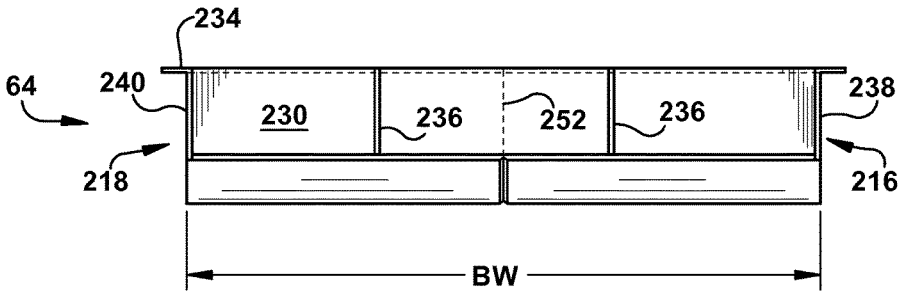
FIG. 6 is a front view of the baffle of FIG. 1.

Referring now to FIG. 1, an exemplary embodiment of an exterior building sidewall (hereafter "sidewall") is shown generally at 10. The sidewall 10 is configured to separate the interior areas 12 of the building from areas 14 exterior to the building, as well as providing a structural, protective and aesthetically pleasing covering to the sides of the building. The sidewall 10 can be formed from various structural framing members, such as the non-limiting examples of top plates 16*a*, 16*b*, and studs 18 extending from the top plates to bottom plates (not shown). The top plates 16*a*, 16*b*, studs 18 and bottom plates can be configured to provide surfaces to which additional framing members or wall panels can be attached. In certain embodiment, the top plates 16*a*, 16*b*, studs 18 and bottom plates are made of wood. In other embodiments, the top plates 16*a*, 16*b*, studs 18 and bottom plates can be made of other desired materials, including the non-limiting example of steel. The top plates 16*a*, 16*b*, studs 18 and bottom plates can have any desired dimensions.

The sidewall 10 has an exterior surface 30 and an interior surface 32. The exterior surface 30 of the sidewall 10 is covered by an exterior sheathing 20 that is attached to the various structural framing members. The exterior sheathing 20 is configured to provide rigidity to the sidewall 10 and also configured to provide a surface for exterior wall coverings 22. In the illustrated embodiment, the exterior sheathing 20 is made of oriented strand board (OSB). In other embodiments, the exterior sheathing 20 can be made of other materials, such as for example plywood, waferboard, rigid foam or fiberboard, sufficient to provide rigidity to the sidewall 10 and to provide a surface for the exterior wall coverings 22.

The exterior wall covering 22 is configured to provide a protective and aesthetically pleasing covering to the sidewall 10. The exterior wall covering 22 can be made of any suitable materials, such as for example brick, wood, stucco or vinyl siding, sufficient to provide a protective and aesthetically pleasing covering to the sidewall 10.

The interior surface 32 of the sidewall 10 can be covered by a construction material 24. In the embodiment illustrated in FIG. 1, the construction material 24 is formed from sections or panels of gypsum or drywall. In other embodiments, the construction material 24 can be any desired material or combination of materials, such as the non-limiting examples of paneling, tile or masonry products.

A ceiling 26 is formed within the interior areas 12 of the building, adjacent the upper portions of the sidewall 10. The ceiling 26 can be attached to ceiling joists (not shown) and can be made from any desired materials, including the non-limiting examples of ceiling tile, drywall or gypsum. Optionally, the ceiling 26 can be covered by ceiling covering materials (not shown), such as for example paint or tile. In still other embodiments, the ceiling 26 can optionally include vapor barriers or vapor retarders (not shown).

A roof structure 34 is connected to the sidewall 10. In the illustrated embodiment, the roof structure 34 includes a plurality of roof support members 36 attached to the sidewall 10. The roof support members can take a wide variety of different forms. For example, the roof support members may be rafters of a rafter and beam-type roof, upper chords of a truss-type roof, or any suitable configuration. The roof support members 36 are configured to support other structures, such as for example, a roof deck 38 and a plurality of overlapping shingles 40. In the illustrated embodiment, the roof support members 36 are made from framing lumber, having sizes including, but not limited to 2.0 inches thick by 10.0 inches wide. Alternatively, the roof support members 36 can be made from other desired materials and have other desired sizes. In the illustrated embodiment, the roof deck 38 is formed from panel-based materials, such as oriented strand board (OSB), having an exterior side 41, and interior side 42, and a thickness T that is equal to about 0.5 inches to about 0.75 inches. In other embodiments, the roof deck 38 can be made of other materials, such as for example, plywood, and may have a thickness greater than 0.75 inches or less than 0.5 inches. While the illustrated embodiment shows the roof structure 34 to be formed from roof support members 36, a roof deck 38 and shingles 40, it should be understood that in other embodiments, the roof structure 34 can include or be formed from other desired structures. It should be further understood that the shingles 40 can be any desired roofing material.

In certain embodiments, portions of the roof structure 34 can further include a first ice and water barrier layer 44 positioned between the roof deck 38 and the shingles 40. The first ice and water barrier layer 44 is configured to protect the roof structure from wind driven rain and from areas of the roof structure where water has a tendency to collect or flow and thereby form an ice dam. The first ice and water barrier layer 44 can be formed from any desired materials. While the embodiment illustrated in FIG. 1 shows a first ice and water barrier layer 41, it should be understood that some regional code authorities require the use of the ice and water barrier layer 44 and other regional code authorities require a standard roofing underlayment in lieu of an ice and water barrier layer. Accordingly, the use of the term "ice and water barrier layer", as used herein, is defined to mean either an ice and water barrier layer or a standard roofing underlayment.

A plurality of fascia boards 46 can be connected to the exterior sheathing 20 and the roof structure 34. The fascia boards 46 are configured for creating a smooth, even appearance on the edge of the roof structure 34 and protecting the roof and the interior of the house from weather damage and as a point of attachment for a plurality of gutters 48. In certain embodiments, the fascia boards 46 can be made from wood materials, such as for example, cedar. In other embodiments, the fascia boards 46 can be formed from other desired materials, including the non-limiting examples of polymeric materials or cementitious materials.

As discussed above, the gutters 48 are attached to the fascia boards 46. The gutters 48 are configured to catch rain water flowing from the roof structure 34 and provide a conduit for the rain water to flow to downspouts (not shown). The gutters 48 can have any desired cross-sectional shape and can be attached to the fascia boards 46 in any desired manner. The gutters 48 have a vertical segment 49 positioned against the fascia boards 46.

Referring again to FIG. 1, in one exemplary embodiment the building structure includes a drip edge or gutter apron 50, which are known to those of ordinary skill in the art. In this application, the terms "drip edge" and "gutter apron" are used interchangeably, since they perform essentially the same function, and even though drip edges and gutter aprons may have different physical configurations. In the illustrated embodiment, a drip edge 50 includes a first segment 52 and a second segment 54. Generally, the drip edge 50 is positioned such that the first segment 52 of the drip edge 50 covers the vertical segment 49 of the gutter 48 and the second segment 54 of the drip edge 50 is positioned over the water barrier layer 44. The drip edge 50 is configured to protect the roof deck 38 and the fascia boards 46 at the edge of the roof structure 34, as well as help water drip clear of the underlying exterior sidewall 10 and into the gutter 48. The drip edge 50 can be made from any desired material, including the non-limiting examples of sheet metal and polymeric materials.

An attic 56 can be formed in the space between the ceiling 26 and the roof structure 34. One of more layers of insulation 58 can be installed in the attic 56 and positioned over the ceiling 26 to insulate the interior areas 12 of the building. The layers of insulation 58 can be any desired type of insulation, such as for example batts or blankets of fibrous insulation or loose-fill insulation, sufficient to insulate the interior areas 12 of the building. Additionally, the layer of insulation 58 can have any desired depth.

A roof deck intake vent 59 may be positioned at the lower edge of the roof structure 34, between the first ice and water barrier layer 44 and a second ice and water barrier layer 60. The roof deck intake vent 59 may be formed in a variety of ways. In one exemplary embodiment, a suitable roof deck intake vent 59 is disclosed in U.S. Published Patent Application 2014/0099877 to Gassman et. al., the entire disclosure of which is incorporated herein by reference. However, any suitable roof intake vent 59 can be used. Generally, the roof deck intake vent 59 is configured as a conduit to allow air, external to the building, to enter the roof structure 34 through an opening 62 formed in the roof deck 38 and flow into the attic 56 as shown by the direction arrows A.

The opening 62 may be configured in a variety of ways. Any opening configured to cooperate with the roof vent for allowing air to flow into the attic may be used. In the exemplary embodiment, the opening 62 is a continuous slot that extends across substantially the length of the roof deck 38 and is oriented in the roof deck to be substantially parallel to the lower edge of the roof deck 38. The opening 62, however, preferably stops about 6 inches from chimneys, end walls, vertical walls, or other obstructions and at least 24 inches from roof valleys. In other embodiments, a series of slots can be formed across the roof deck 38, such as for example, individual slots cut between the roof support members 36, such as rafters and truss chords. Roof rafters or truss chords 36 are commonly spaced at 16 inches on center or 24 inches on center, though other spacing is possible.

Figure 7:
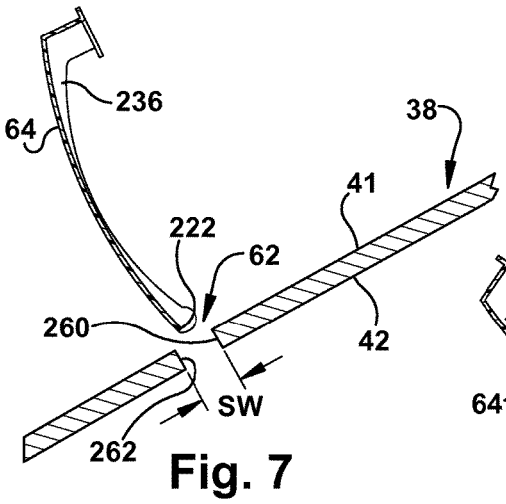
FIGS. 7-11 are side views of the baffle of FIG. 1 being installed through an opening in a roof deck.
Figure 8:
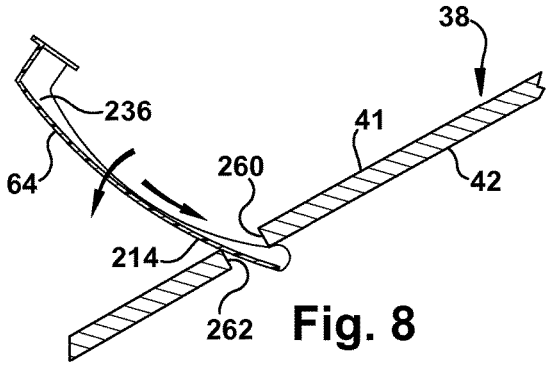
Figure 9:
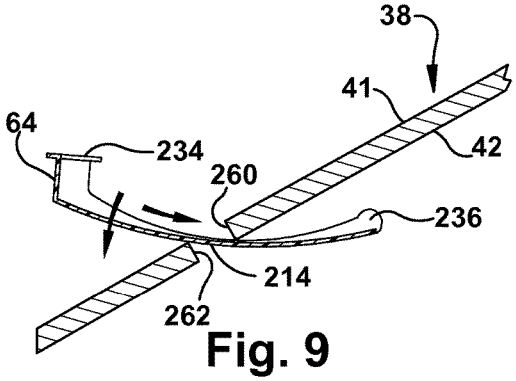
Figure 10:
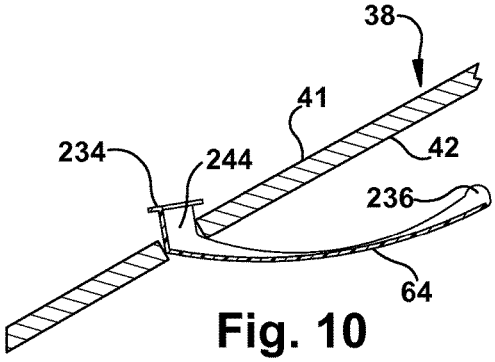
Figure 11:
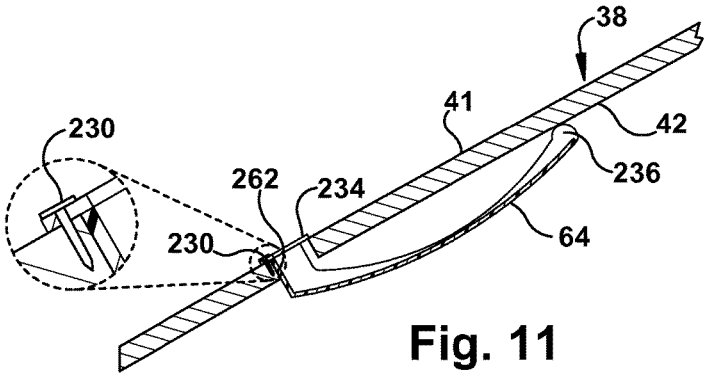

As shown in FIG. 7, the opening 62 has a width SW. In the illustrated embodiment, the width SW of the opening 62 is in a range of from about 1.0 inch to about 3.0 inches, and preferably about 1.5 inches. In other embodiments, the width SW of the opening 62 can be less than about 1.0 inch or more than about 3.0 inches. Referring to FIG. 1, the opening 62 is formed a distance DS from the front edge of the drip edge 50. In the illustrated embodiment, the distance DS is in a range of from about 4.0 inches to about 8.0 inches, and preferably about 6.0 inches. In other embodiments, the distance DS can be less than about 4.0 inches or more than about 8.0 inches. If no drip edge 50 is used, the location of the opening 62 can be measured a distance from the suitable reference point, such as for example the front edge of the fascia boards 46.

FIG. 1 shows an exemplary embodiment of a baffle 64 installed along the interior side 42 of the roof deck 38 and between adjacent roof supports 36. The baffle 64 is configured to create a flow path between adjacent supports 36 and between the insulation layer 58 and the interior side 42 of the roof deck 38 such as to allow air to flow freely up the interior side and into the attic 56 unimpeded by the insulation layer 58. In addition, the baffle 64 is configured such that it can be inserted from the exterior side 41 of the roof deck 38, through the opening 62 and into the attic 56, and secured in place from the exterior side of the roof deck. The baffle 64 may take a wide variety of different forms. Any structure capable of being inserted through an opening in the roof deck 38 to form an air flow path between the interior side 42 of the roof deck and the insulation layer 58 may be used.

Referring to FIGS. 2-6, in the illustrated exemplary embodiment, the baffle 64 has a relatively broad and thin sheet or panel-like body 210 having upper face 212 and a lower face 214 generally parallel to the upper face. In the illustrated embodiment, the body 210 is curved such that the upper face 212 is concave and the lower face 214 is convex. In other embodiments, however, the body 210 may not be curved, but may rather, for example, be segmented, angular or straight. The body 210 includes a first side 216, a second side 218 generally parallel to the first side and a distance BW from the first side, a forward end 220 having a leading edge 222 generally parallel to and extending between the first side and second side, and a rearward end 224 having a trailing edge 226 generally parallel to and extending between the first side and second side and spaced apart from the leading edge 222 a length BL.

The rearward end 224 includes a wall 230 that extends outward from and traverse to the upper face 212. The wall 230 extends from the first side 216 to the second side 218 of the upper face 212, includes a distal edge 232, and has a height WH. The distal edge 232 may include a flange 234 extending along the wall 230. As will be discussed in another section, the flange 234 may function as an attachment surface for attaching the baffle 64 to the roof deck 38 and a positioning mechanism to ensure the baffle is properly positioned along the interior side 42 of the roof deck. In other embodiments of the baffle 64, the attachment function and the positioning function can be achieved by structure other than a flange. Any structure or plurality of structures capable of facilitating attaching the baffle to the roof deck or properly positioning the baffle in place may be used. For example, in some embodiments, the baffle 64 may be attached to an edge of the opening 62 through the wall 230, or attachment may be made through the edge flanges 234, extending beyond side walls 216 and 218.

The baffle 64 also includes one or more ribs 236 extending from the upper face 212. The one or more ribs 236 may be configured in a variety of ways. In the depicted embodiment, the one or more ribs 236 extend from the wall 230 to the leading edge 222. In other embodiments, however, the one or more ribs may be non-continuous. For example, one or more of the ribs 236 may only extend from the upper face 212 at the leading edge 222 and not extend along the upper face to the wall 230. In the illustrated embodiment, one of the ribs 236 is attached to the first side 216 of the body 210 to form a first side wall 238 and a second of the ribs 236 is attached the second side 218 to form a second side wall 240. Furthermore, in the illustrated embodiment, the baffle 64 includes four ribs, but in other embodiments the baffle may include more or less than four ribs. For example, the baffle 64 may have one rib 236 forming the first side wall 238 and another rib forming the second side wall 240 and no additional ribs.

Each of the ribs 236 includes a forward portion 242, a rearward portion 244, and an intermediate portion 246 positioned between the forward portion and the rearward portion. In the depicted embodiment, the ribs 236 have a height RH that varies along the length of the ribs. In particular, the height RH of the ribs 236 is less in the intermediate portion 246 than at the forward portion 242 and the rearward portion 244. At the forward portion 242, the ribs include a rounded end 248 (FIG. 4) and at the rearward portion 244 the ribs 236 have a height RH that extends to the distal edge 232 of the wall 230. The flange 234 may extend along a portion of the side of the first side wall 238 and the second side wall 240.

The baffle 64 may optionally include an aid for sectioning the baffle into discrete portions. For example, in the exemplary embodiment, the baffle 64 includes a notch 250 in the flange 234 and a groove or perforated line 252 that extends through the wall 230 and the body 210 from the rearward end 224 to the forward end 220. The notch 250 and the groove or perforated line 252 bisect the baffle 64 to facilitate separating the baffle in half along its length. In other embodiments, the location of the aid for sectioning the baffle 64 into discrete portions may vary.

The dimensions of the baffle 64 may vary amongst different embodiments, not only in absolute terms but in relative terms amongst the dimensions. For example, different dimensions for the baffle 64 may be used for different applications in which the roof deck thickness, the roof support member spacing, and opening may vary. In one example, the roof deck thickness T is about 0.5 inches, the support member spacing is about 16 inches on center, and the opening width SW is about 1.5 inches. An example of a suitable baffle 64 embodiment for use in this example may have the length BL of about 12 inches to about 24 inches (or 12 inches to 24 inches), the width BW of about 12 inches to about 14 inches (or 12 inches to 14 inches), the wall height WH of about 1.0 to about 1.5 inches, and the rib height RH of the forward portion 242 of about 1.0 inch. One exemplary vetn 64 has a length BL of 12 inches, a width BW of 14 inches, the wall height WH of 1.0 to 1.5 inches, and the rib height RH of the forward portion 242 of 1.0 inch.

The baffle 64 may be made of any suitable material. Any material able to provide a sufficient air flow path between the roof baffle and the roof deck may be used. In the exemplary embodiment, the baffle 64 is made as a single piece, rigid polypropylene structure by any suitable process, such as by injection molding, for example. In other embodiments, however, the baffle 64 need not be a single piece and may be made from other materials. For example, the baffle 64 may include a rigid exterior frame supporting a flexible body portion.

Referring to FIGS. 7-11, the opening 62 is cut into the roof deck 38. The opening 62 includes an upper edge 260 and a lower edge 262. From the exterior side 41 of the roof deck 38, the installer inserts the baffle 64 into the opening 62 leading edge 222 first. Initially, the baffle 64 is inserted into the opening 62 generally perpendicular to the roof deck 38. As the baffle 64, however, is received through the opening 62, the baffle is rotated counterclockwise (as shown by arrows in FIGS. 8 and 9) such that lower edge 262 of the opening 62 engages the bottom face 214 of the body 210 and the upper edge 260 of the opening 62 engages the ribs 236. Once the baffle 64 has been inserted into the opening 62 up to the rearward portion 244 of the ribs 236 (FIG. 10), the baffle can be further rotated such that the flange 234 is parallel to the exterior side 41 of the roof deck 38. The baffle 64 may then be shifted toward the lower edge 262 of the opening 62 such that the wall 230 engages the lower edge. In this position, the flange 234 overlaps the roof deck 38 and can be attached to the exterior side 41 of the roof deck by any suitable means, such as for example, one or more fasteners 264, such as nails, staples, or screws, or by an adhesive or another suitable manner. In some embodiments, one or more secondary attachment fasteners (not shown) can be secured to the baffle 64 in the proximity of the leading edge 222. For example, the baffle 64 could include fastener attachment points, such as a receiver opening or attachment surface, at the leading edge 222. Fasteners can be inserted through the roof deck 38 and into the attachment points at the leading edge 222 to support and secure the leading edge in the final installed position.

In this position, the body 210 of the baffle 64 extends along the interior side 42 of the roof deck 38. The forward portion 242 of the ribs 236 may contact the interior side 42 of the roof deck 38 but the rib height RH at the forward portion ensures that an air flow path between the baffle 64 and the roof deck 38 is maintained. For example, in the exemplary embodiment, the rib height RW at the forward portion is about 1.0 inches. Thus, a continuous, clear vertical space, unobstructed by insulation 58, is provided along the interior side 42 of the roof deck 38. The present disclosure, therefore, provides a method of inserting a baffle through a roof deck that uses the length BL, the rib height RH, and the slot width SW along with the physical geometry of the vent structure to allow insertion and installation of the baffle from outside of the roof attic. Further, the present disclosure provides a method which allows an externally inserted baffle to create and maintain a clear ventilation air space and ventilation path between the interior side 42 of the roof deck 38 and any insulation 58 (loose fill, batt, rolled or other configuration) or other material present in the attic.

During installation, the leading edge 222 of the baffle 64 may impact existing insulation 58 in the attic. In the exemplary embodiment, the baffle 64 is made of rigid polypropylene with sufficient stiffness to push the existing insulation 58 away from the interior side 42 of the roof deck 38 without bending or otherwise deforming the vent. In addition, the solid body 210 provides sufficient strength such that any loose fill insulation that may be inadvertently captured between the roof deck 38 and the baffle 64 during installation of the vent, can be blown clear of the flow path by, for example, a blast of compressed air or airflow from a high velocity leaf blower directed through the opening 62 from the exterior side 41.

In an exemplary embodiment, the width BW of the baffle 64 is about 14 inches. Thus, the baffle 64 may fit between support members 36 that have a standard spacing of 16 inches on center. For buildings in which the spacing of support members 36 is 24 inches on center, the baffle 64 may be sectioned along the groove or the perforated line 252 by tearing or cutting. In the exemplary embodiment, the groove or the perforated line 252 bisects the baffle 64, so separating the baffle along the groove or the perforated line yields two baffle sections with a width BW of about 7.0 inches. One of the two baffle sections may be combined with an unsectioned baffle 64 to span about 21 inches between the 24 inches on center support members. In another embodiment, the baffle 64 may have a width BW of 21 inches to span between support members 36 that have a spacing of 24 inches on center and may or may not include notches or perforations that allow or accommodate different or additional support member spacing.

While the principles and mode of operation of the baffle have been described in its preferred embodiments, it is not the intention of the applicant to restrict or in any way limit the scope of the appended claims to such detail. It should be noted that the baffle may be practiced otherwise than as specifically illustrated and described without departing from its scope. Additional advantages and modifications will readily appear to those skilled in the art. Therefore, the invention, in its broader aspects, is not limited to the specific details, the representative apparatus, and illustrative examples shown and described. Accordingly, departures can be made from such details without departing from the spirit or scope of the applicant's general inventive concept.

The invention claimed is:

1. A roof assembly comprising:

a roof deck supported by a plurality of support members, wherein the roof deck spans at least two of the support members, wherein the roof deck has an exterior side, an interior side, and an opening connecting the exterior side to the interior side;

a baffle attached to the exterior side of the roof deck, the baffle comprising:

a main body having an upper face, a forward end portion, a rearward end portion opposite the forward end portion, and a first side wall extending between the forward end portion and the rearward end portion;

an attachment surface extending from the rearward end portion; and at least one rib extending from the upper face and extending from the forward end portion to the rearward end portion;

wherein the baffle extends through the opening of the roof deck such that the main body extends along the interior side of the roof deck and the attachment surface is attached to the exterior side of the roof deck to secure the baffle in place.

2. The roof assembly of claim 1 wherein the upper face of the main body of the baffle is concave.

3. The roof assembly of claim 1 wherein the at least one rib of the baffle has a height and a length and wherein the height varies along the length of the rib.

4. The roof assembly of claim 3 wherein the at least one rib of the baffle has a first height at the forward end portion, a second height at the rearward end portion, and a third height between the forward end portion and the rearward end portion, the third height being less than the first height and the second height.

5. The roof assembly of claim 1 wherein the at least one rib of the baffle has a height at the forward end portion of about 1 inch or more relative to the upper face at the forward end portion.

6. The baffle roof assembly of claim 1 wherein the main body of the baffle is a single piece, rigid polypropylene body.

7. The roof assembly of claim 1 wherein the baffle has a width of about 14 inches and a length of about 12 inches such that the baffle is installable through a horizontal opening of about 1.5 inches wide.

8. A roof assembly, comprising:

a roof deck supported by a plurality of support members, wherein the roof deck spans at least two of the support members, and wherein the roof deck has an exterior surface and an interior surface;

an opening formed in the roof deck extending horizontally between two of the plurality of support members;

a baffle attached to the exterior surface of the roof deck, the baffle having a total width defined by a first side and a second side spaced apart from the first side, wherein the baffle extends through the opening and along the interior surface of the roof deck to form an air flow path between the baffle and the interior surface, and wherein the first side and the second side are positioned between adjacent support members, wherein the baffle comprising a main body portion extending along the interior surface of the roof deck and an attachment surface that attaches the baffle to the exterior surface of the roof deck;

wherein a surface area of the main body is larger than a surface area of the attachment surface.

9. The roof assembly of claim 8 wherein:

the main body portion has a concave upper surface, a forward end portion, and a rearward end portion opposite the forward end portion; and the attachment surface extends from the rearward end portion of the main body.

10. The roof assembly of claim 9 wherein the baffle further comprises a plurality of ribs extending from the forward end portion to the rearward end portion, each of the plurality of ribs having a height at the forward end portion and a rearward end portion that is greater than a height between the forward end portion and a rearward end portion.

11. The roof assembly of claim 8 wherein the baffle extends about 8 inches or more along the interior surface of the roof deck.

12. The roof assembly of claim 9 wherein at least one rib has a forward portion at the forward end portion of the main body that contacts the interior surface of the roof deck.

13. The roof assembly of claim 12 wherein the forward portion of the at least one rib includes a rounded end.

14. A roof assembly comprising:

a roof deck attached to and supported by a plurality of support members, wherein the roof deck spans at least two of the support members, wherein the roof deck has an exterior side, an interior side, and an opening connecting the exterior side to the interior side, wherein the opening extends between an adjacent pair of the support members and has a width of less than three inches;

a baffle attached to the exterior side of the roof deck, the baffle comprising:

a main body having an upper face, a forward end portion, and a rearward end portion opposite the forward end portion; and an attachment surface extending from the rearward end portion;

wherein a surface area of the main body is larger than a surface area of the attachment surface;

wherein the baffle is installed from the exterior side of the attached roof deck, through the less than three inch wide opening and between adjacent roof support members, that are less than 24 inches apart, such that the main body extends along the interior side of the roof deck between the adjacent roof support members and the attachment surface is attached to the exterior side of the roof deck to secure the baffle in place.

15. The roof assembly of claim 14 wherein the main body of the baffle includes a first side and a second side opposite the first side, the attachment surface of the baffle extending along at least a portion of the first side and along at least a portion of the second side.

16. The roof assembly of claim 1, wherein the first side wall of the main body of the baffle has a first wall height at the forward end portion, a second wall height at the rearward end portion, and a third wall height between the forward end portion and the rearward end portion, the third wall height being less than the first wall height and the second wall height.

* * * * *